US008397961B2

(12) United States Patent
Viehe

(10) Patent No.: US 8,397,961 B2
(45) Date of Patent: Mar. 19, 2013

(54) CLOTHING STORAGE APPARATUS

(76) Inventor: Julie Nixon Viehe, Round Rock, TX (US)

( * ) Notice: Subject to any disclaimer, the term of this patent is extended or adjusted under 35 U.S.C. 154(b) by 92 days.

(21) Appl. No.: 12/911,480

(22) Filed: Oct. 25, 2010

(65) Prior Publication Data

US 2012/0097717 A1 Apr. 26, 2012

(51) Int. Cl.
*A41D 27/22* (2006.01)

(52) U.S. Cl. ..... 223/85; 223/88; 223/92; 211/85.3

(58) Field of Classification Search ..... 223/85, 223/88, 92; 211/85.3, 96, 113, 115, 116
See application file for complete search history.

(56) References Cited

U.S. PATENT DOCUMENTS

| | | | | | |
|---|---|---|---|---|---|
| 1,462,067 | A | * | 7/1923 | McKenna | 223/88 |
| 2,549,588 | A | * | 4/1951 | Fillenbaum | 223/88 |
| 2,987,193 | A | * | 6/1961 | Pajor | 211/96 |
| 3,212,647 | A | | 10/1965 | Meyer et al. | |
| 3,352,430 | A | * | 11/1967 | McAtee | 223/96 |
| 4,029,212 | A | * | 6/1977 | Uadiski | 211/113 |
| 4,058,222 | A | | 11/1977 | Singer | |
| 4,129,218 | A | | 12/1978 | Koellner | |
| 4,278,177 | A | * | 7/1981 | Fahmi | 211/116 |
| 4,366,909 | A | * | 1/1983 | Fahmi | 211/116 |
| 4,585,127 | A | * | 4/1986 | Benedict | 211/34 |
| 4,723,665 | A | * | 2/1988 | Benedict et al. | 211/96 |
| 5,019,126 | A | | 5/1991 | Post | |
| 5,405,065 | A | | 4/1995 | Olson | |
| 5,680,972 | A | | 10/1997 | Clarke | |
| 6,003,743 | A | | 12/1999 | Deady | |
| 6,105,795 | A | | 8/2000 | Terragni | |
| 6,769,555 | B2 | | 8/2004 | Brady | |
| 7,182,232 | B2 | | 2/2007 | Fleming et al. | |
| 2003/0183666 | A1 | | 10/2003 | Kameda | |
| 2005/0224531 | A1 | * | 10/2005 | Bulovic | 223/85 |
| 2006/0186149 | A1 | | 8/2006 | Wu | |
| 2007/0215567 | A1 | | 9/2007 | Cavell | |
| 2007/0241143 | A1 | | 10/2007 | Box et al. | |
| 2007/0251961 | A1 | | 11/2007 | Fryer et al. | |
| 2008/0116160 | A1 | | 5/2008 | McNicholas | |
| 2008/0230500 | A1 | | 9/2008 | Johnson | |
| 2009/0224009 | A1 | | 9/2009 | Lubow | |

OTHER PUBLICATIONS

Onlyhangers.com, "Product Detail—Metal Wonder Hangers," Wonder Hangers, Apr. 5, 2010, 2, USA.

* cited by examiner

*Primary Examiner* — Nathan Durham
(74) *Attorney, Agent, or Firm* — Sean Christian Connolly

(57) ABSTRACT

An apparatus for organizing and storing multiple items of clothing comprising an upside-down L-shaped body with an upper horizontal arm which includes two parallel hooks used to hang the apparatus from a standard closet bar, and a lower vertical arm which includes a rear-mounted brace that may be adjusted to support the apparatus against the rear wall of a closet, with the two arms being connected at a substantially perpendicular angle and reinforced by a cross-bar; and a plurality of hanger arrays depending from the lower vertical arm, with each hanger array comprising a plurality of hanger members that have two ends and are peaked in the middle and are each attached on one end to the lower vertical arm by a vertical hinge with the other end remaining accessible.

1 Claim, 12 Drawing Sheets

CLOTHING STORAGE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention is in the technical field of organization and storage systems. More particularly, the preferred embodiments of the present invention relate generally to organization and storage systems for clothing. More particularly, the preferred embodiments of the present invention relate generally to clothing organization and storage systems which allow for multiple items of clothing to be stored in a relatively compact area, enabling more efficient storage in limited spaces. Furthermore, the preferred embodiments of the present invention relate generally to organization and storage systems for clothing which allowing the multiple items of clothing to be easily sorted and displayed.

2. Description of the Related Art

Closets and wardrobes intended for storing clothing are often limited in the amount of available space. Large collections of clothing may fill such a clothing storage spaces to such an extent that easily searching through the collection becomes difficult. It is desirable to make the most efficient use of limited closet space by increasing the number of clothing items which may be stored in a given volume. Several inventions have attempted to increase the usefulness of limited closet space.

The broad concept of a device which hangs multiple garments is known. Some of these devices are related to storage and organization while others relate to displaying or transporting multiple garments. Some devices allow for several standard garment hangers to be suspended from a singular base which is capable of being independently suspended. Other devices have sets of integrated hanger appendages which may accommodate multiple items of clothing. A number of these devises allow for several clothes hangers to be chained together and suspended from a primary hanger. Additional devices consist of single-bodied hangers with multiple means of attaching items of clothing to the hanger such that several clothing items may be suspended from one hanger. Lastly, some devices consist of racks which are suspended from a closet bar which may store folded garments.

Devices which allow for several standard hangers to be suspended from a singular base, which is then independently suspended, allow for multiple items of clothing to be stored in a limited space but have other problems which arise from this design. Sorting through the items of clothing stored may be difficult because to view underlying clothing the standard hangers must be removed or shifted to the side risking upset of the hanging clothing. These devices also require standard hangers to directly suspend the items of clothing and are susceptible to any failures in these standard hangers. Additionally, some versions of these devices suspend standard hangers from cord or string which is more susceptible to breakage than metal or wood.

Devices which have sets of integrated hanger appendages may accommodate multiple items of clothing; however, known version of this design are problematic. Some of these devices have hanger appendages which interfere with each other when loaded with clothing. Others may become unbalanced while being loaded with clothing. Additionally, some hanger appendages are not well suited for suspending clothing and may require clips to fix the clothing in place.

Devises which allow for several clothes hangers to be chained together and suspended from a primary hanger enable the efficient storage of clothing, but may be ungainly is actual use. A chain is only as strong as its weakest link, and the failure of one hanger may cause the entire device to fail. Devices consisting of hanger chains are also not easy to move around since movement may disrupt the chain.

Devices which consist of single-bodied hangers with multiple means of attaching items of clothing to the hanger do allow for several clothing items to be suspended from one hanger; however, they are often limited in the number of items capable of being stored. Some of these devices may easily store different items of clothing on one hanger, such as a shirt and a pair of pants together on one hanger, but have difficulty in storing multiple items of the same type of clothing, such as several shirts. Some of these devices extend the dimensions of the single hanger to enable more items of clothing to be stored but this method sacrifices closet space to do so. Other versions allow for several items of clothing to be clipped together on one hanger, but these versions make searching through the items of clothing difficult.

Devices which consist of racks which are suspended from a closet bar which may store folded garments enable a large number of garments to be stored, but requires those garments to be folded while stored. Folded garments are susceptible to creasing while freely hanging garments are less likely to become creased. Additionally, stacks of folded garments are not clearly displayed and searching through a stack of folded clothing will likely upset the quality of folded garments.

SUMMARY OF THE INVENTION

The embodiments of the present invention are Clothing Storage Apparatuses comprising a body, with a means to hang from a standard closet bar, and a hanger array depending from the body and comprising one or more hanger members, each of which being capable of supporting an item of clothing. The hanger members attach to the body by a vertical hinge, thereby enabling the hanger member to be adjusted in a substantially 180-degree arc. The adjustability of the hanger members permits items of clothing to be easily loaded onto the apparatus, allows a user of the apparatus to proficiently search through a collection of clothing and also enables the items of clothing to be stored in a substantially flat volume. A Clothing Storage Apparatus allows for multiple items of clothing to be stored in a space normally used by one item of clothing.

In other preferred embodiments of Clothing Storage Apparatuses, the body further comprises an upside-down L-shaped structure comprising an upper horizontal arm and a lower vertical arm. The horizontal arm and the vertical arm are connected at a substantially perpendicular angle and reinforced by a cross-bar.

In other preferred embodiments of Clothing Storage Apparatuses, the means of hanging from a standard closet bar comprises two parallel hooks which fasten around the closet bar.

In other preferred embodiments of Clothing Storage Apparatuses, the apparatus further comprise a rear-mounted brace which support the apparatus against a rear wall of a closet. The rear-mounted brace is provided with a means of adjusting its length, so that its length may be conformed to the distance between the rear of the apparatus and the closet wall in such a manner as to hold the apparatus substantially vertical within a closet, thereby preventing the apparatus from becoming unbalanced when loaded with items of clothing.

In other preferred embodiments of Clothing Storage Apparatuses, each hanger array comprises a plurality of hanger members.

In other preferred embodiments of Clothing Storage Apparatuses, the apparatuses further comprise a plurality of hanger arrays depending from the body.

In other preferred embodiments of Clothing Storage Apparatuses, the hanger members further comprise an inner end, an outer end and a middle. The inner end is attached to the body by a vertical hinge and the outer end freely suspended. The middle is peaked such that the center is vertically higher than either the inner end or the outer end.

In the most preferred embodiments, Clothing Storage Apparatuses comprise a body with a means to hang from a standard closet bar, and a plurality of hanger arrays depending from the body. The body comprises an upside-down L-shaped comprising an upper horizontal arm and a lower vertical arm. The horizontal arm and the vertical arm are connected at a substantially perpendicular angle and reinforced by a cross-bar. Two parallel hooks extend from the open end of the upper horizontal arm and enable the apparatus to be fastened to a closet bar. A rear-mounted brace extends from the lower vertical arm and supports the apparatus against a rear wall of a closet. The rear-mounted brace is provided with a means of adjusting its length, so that its length may be conformed to the distance between the rear of the apparatus and the closet wall in such a manner as to hold the apparatus substantially vertical within a closet, thereby preventing the apparatus from becoming unbalanced when loaded with items of clothing. Each hanger array comprises a plurality of hanger members, each of which being capable of supporting an item of clothing. The hanger members comprise an inner end, an outer end and a middle. The inner end is attached to the lower vertical arm by a vertical hinge and the outer end is freely suspended. The middle is peaked such that the center is vertically higher than either the inner end or the outer end. The vertical hinge enables a hanger member to be adjusted in a substantially 180-degree arc. The adjustability of the hanger members permits items of clothing to be easily loaded onto the apparatus, allows a user of the apparatus to proficiently search through a collection of clothing and also enables the items of clothing to be stored in a substantially flat volume. A user of the apparatus may load an item of clothing by sliding it over the exposed out end of a hanger member. Once loaded, the item of clothing on the hanger array may be swung aside in order to load another item of clothing or to examine other items of clothing which may be already mounted on the apparatus. A Clothing Storage Apparatus is a convenient and efficient means for storing multiple items of clothing in limited closet space.

BRIEF DESCRIPTION OF THE DRAWING

Illustrative and preferred embodiments of the present invention are shown in the accompanying drawings in which.

DETAILED DESCRIPTION OF THE PREFERRED EMBODIMENTS

For the purpose of illustration, the present invention is shown in the preferred embodiments of a Clothing Storage Apparatus in isolation and a Clothing Storage Apparatus which is mounted in a closet. Additionally, a Clothing Storage Apparatus is demonstrated storing shirts. These embodiments are not intended to limit the scope of the present invention.

Figure 1:
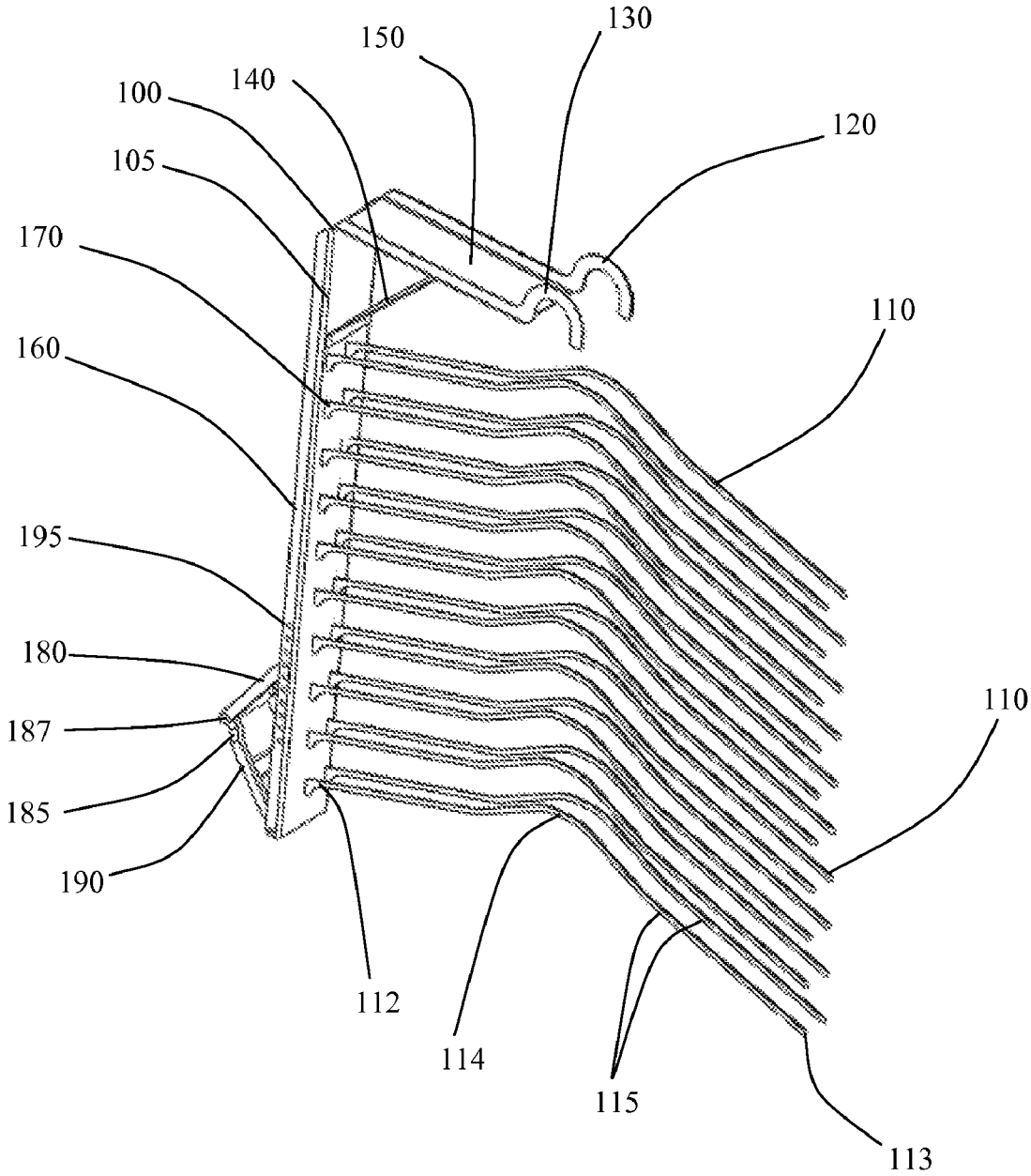
FIG. 1 is a perspective view of an apparatus of the present invention.
Figure 2:
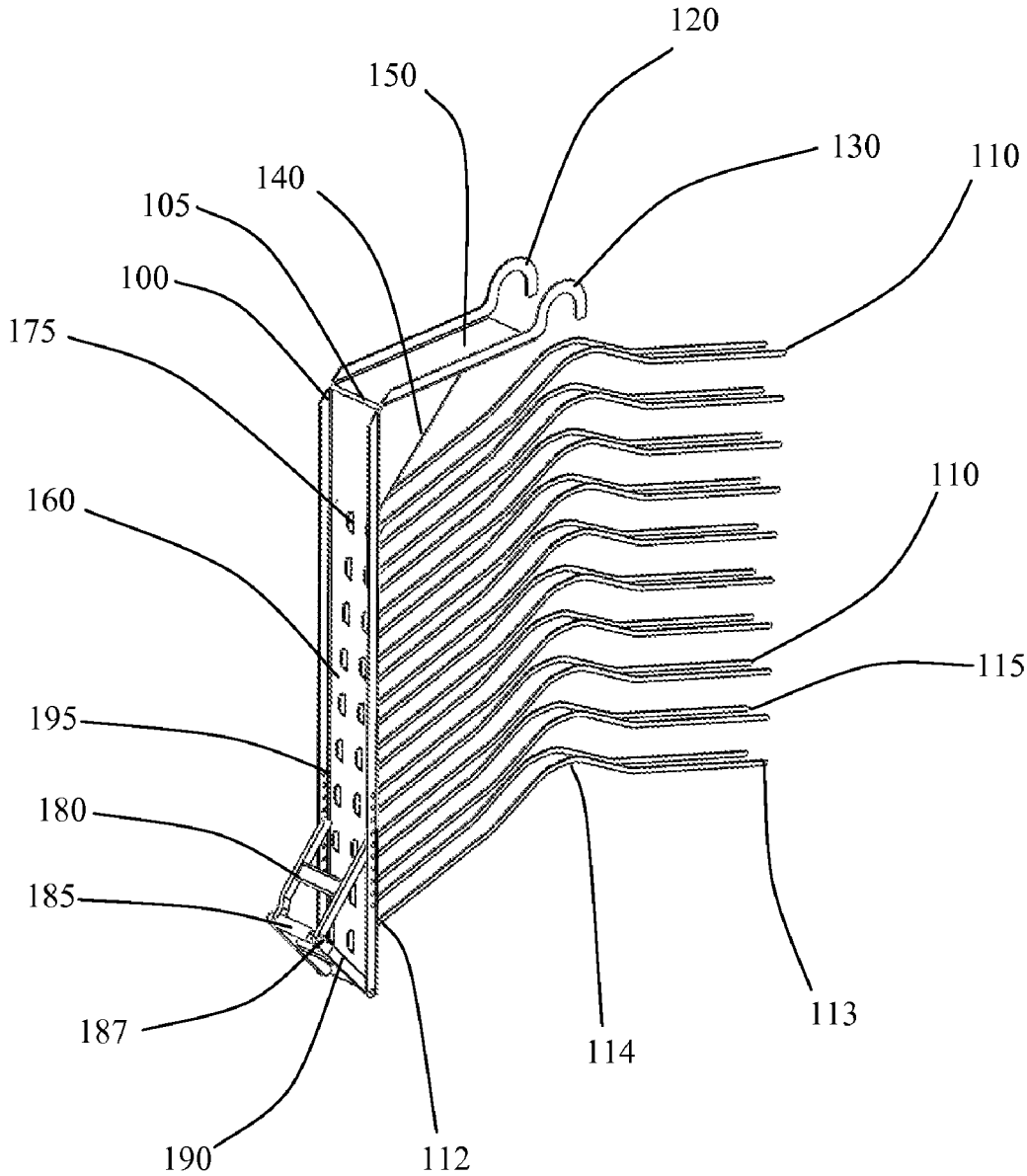
FIG. 2 is a rear perspective view of an apparatus of FIG. 1.
Figure 3:
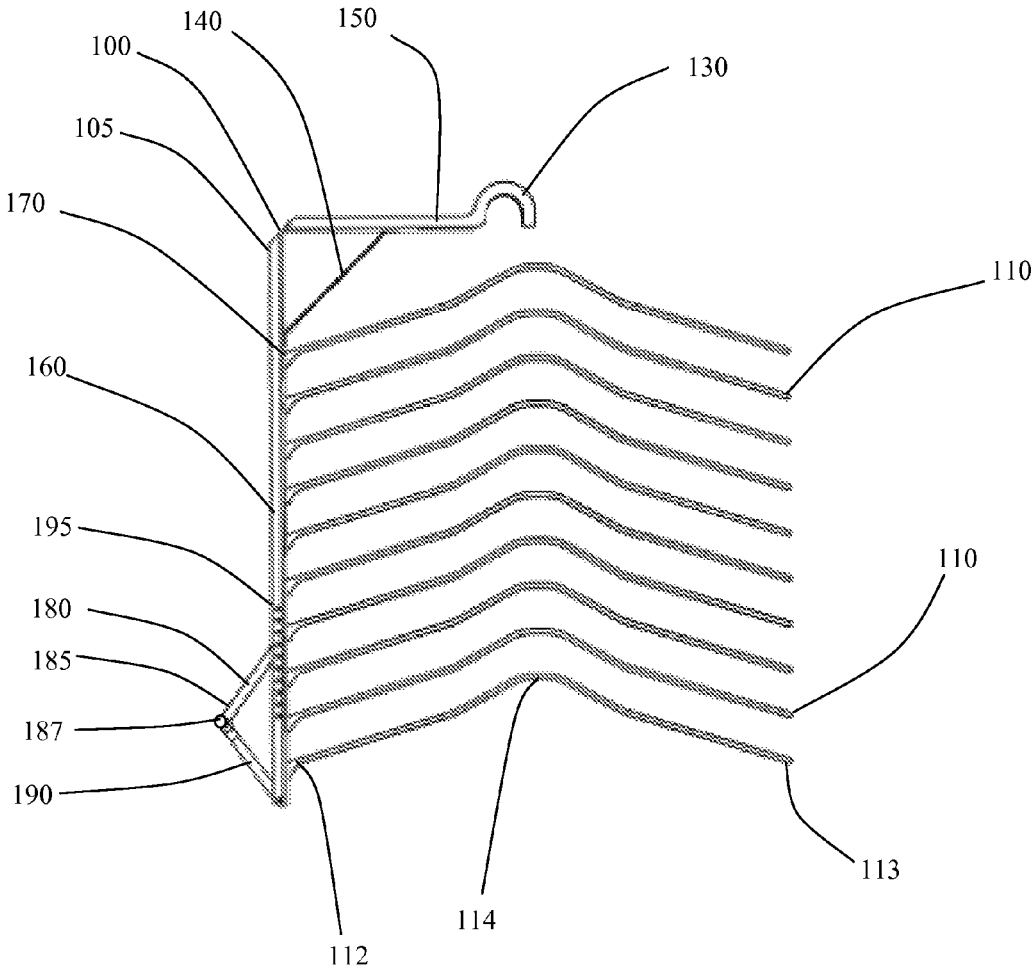
FIG. 3 is an side view of an apparatus of FIG. 1.
Figure 4:
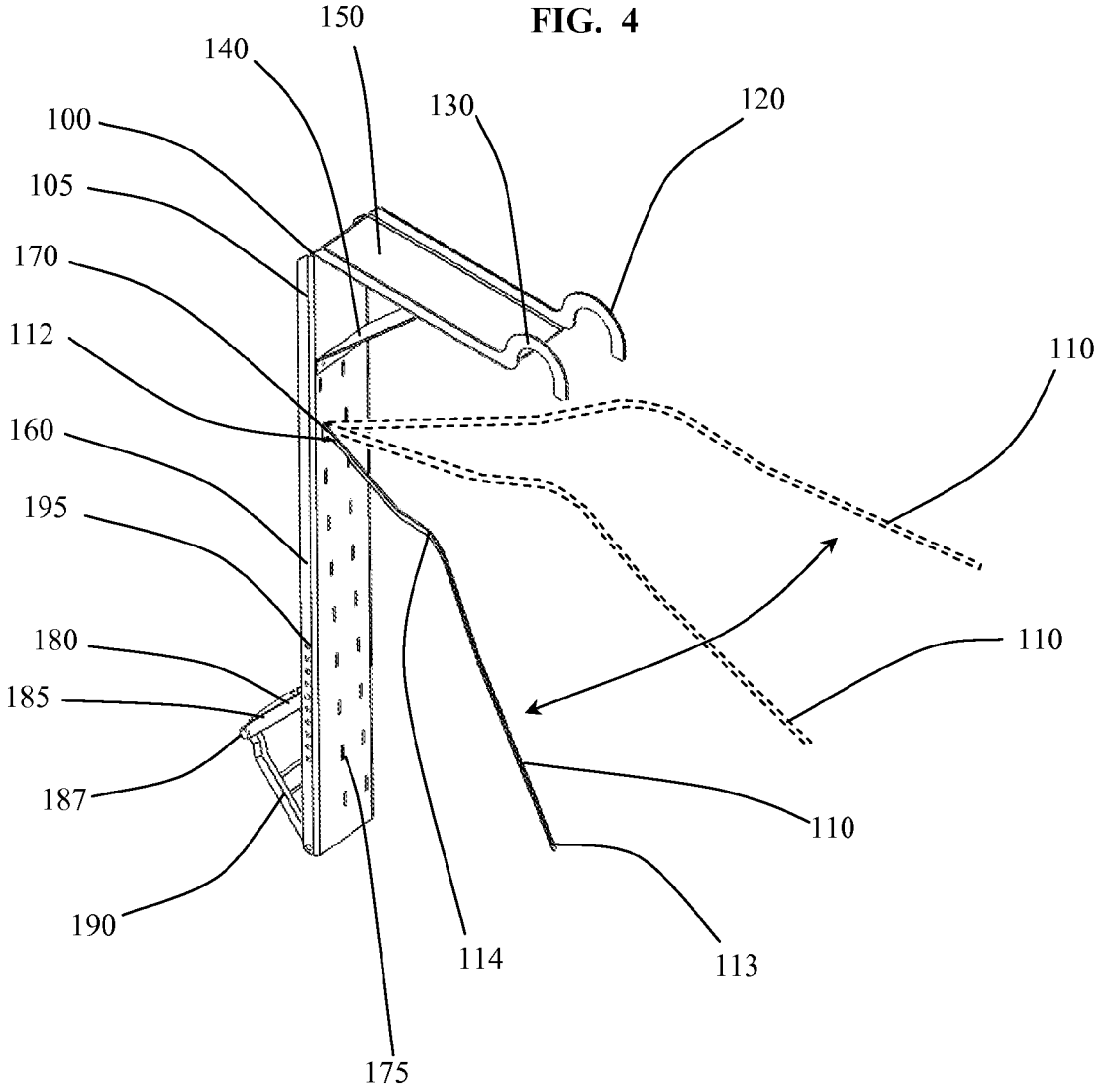
FIG. 4 is a perspective view of an apparatus of FIG. 1 with only one hanger member installed and showing the range of motion of the hanger member.
Figure 5:
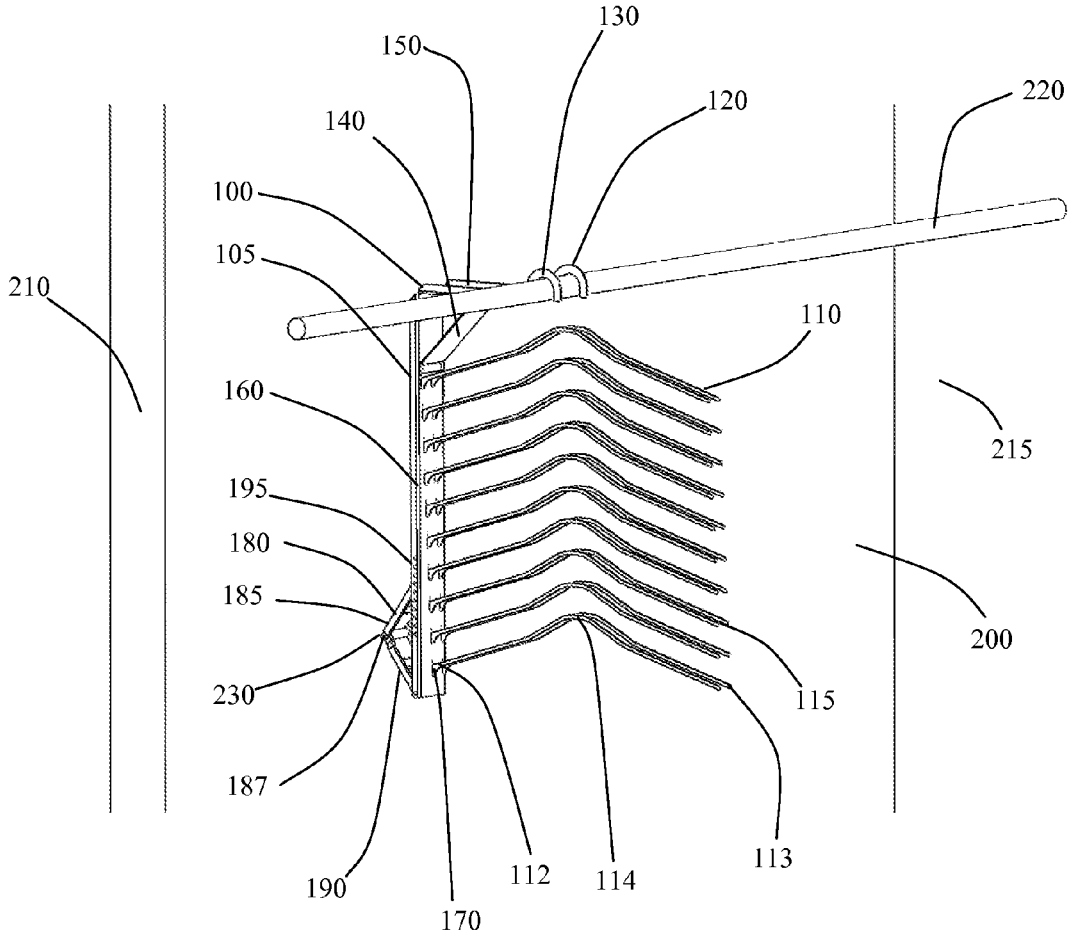
FIG. 5 is a perspective view of an apparatus of FIG. 1 mounted within a closet.
Figure 6:
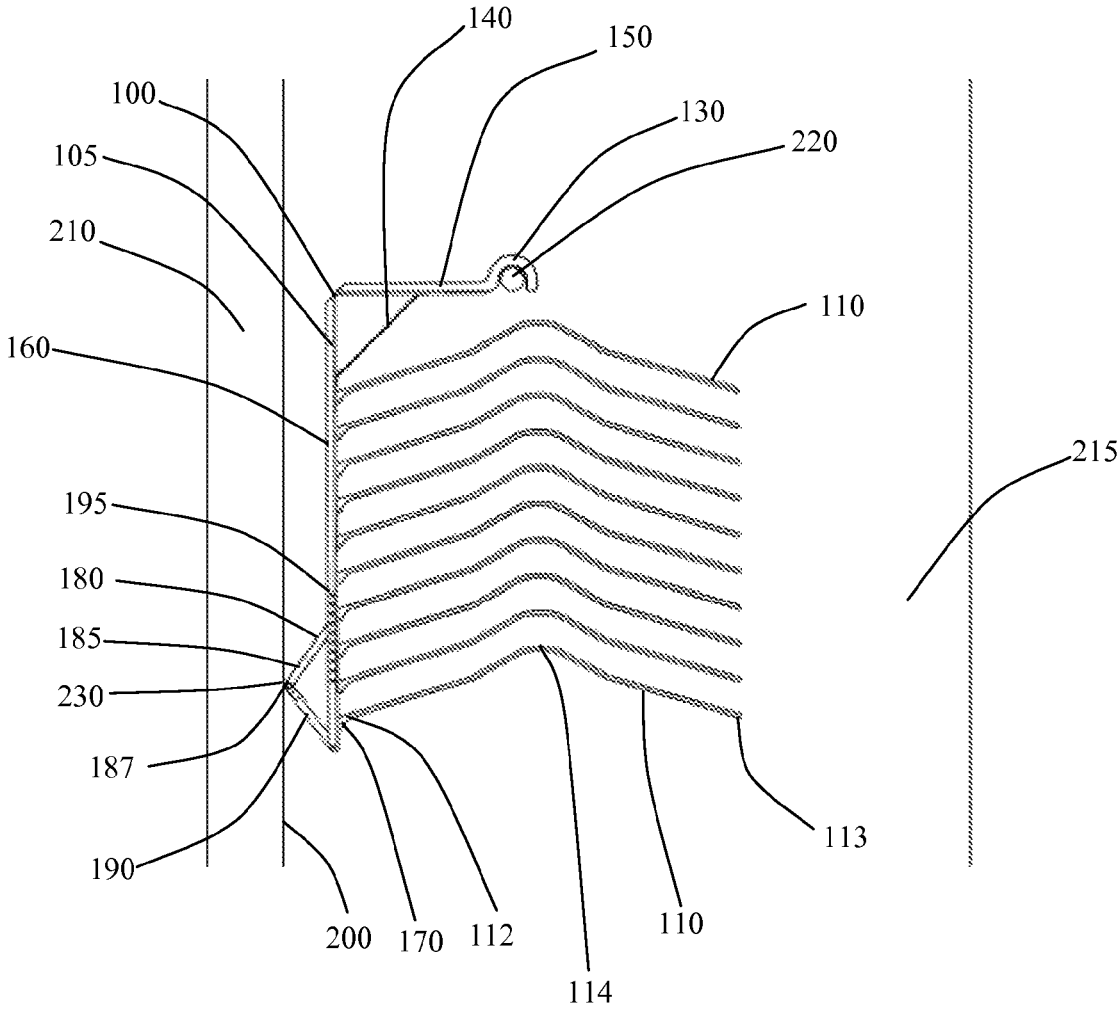
FIG. 6 is a side view of an apparatus of FIG. 1 mounted within a closet.
Figure 7:
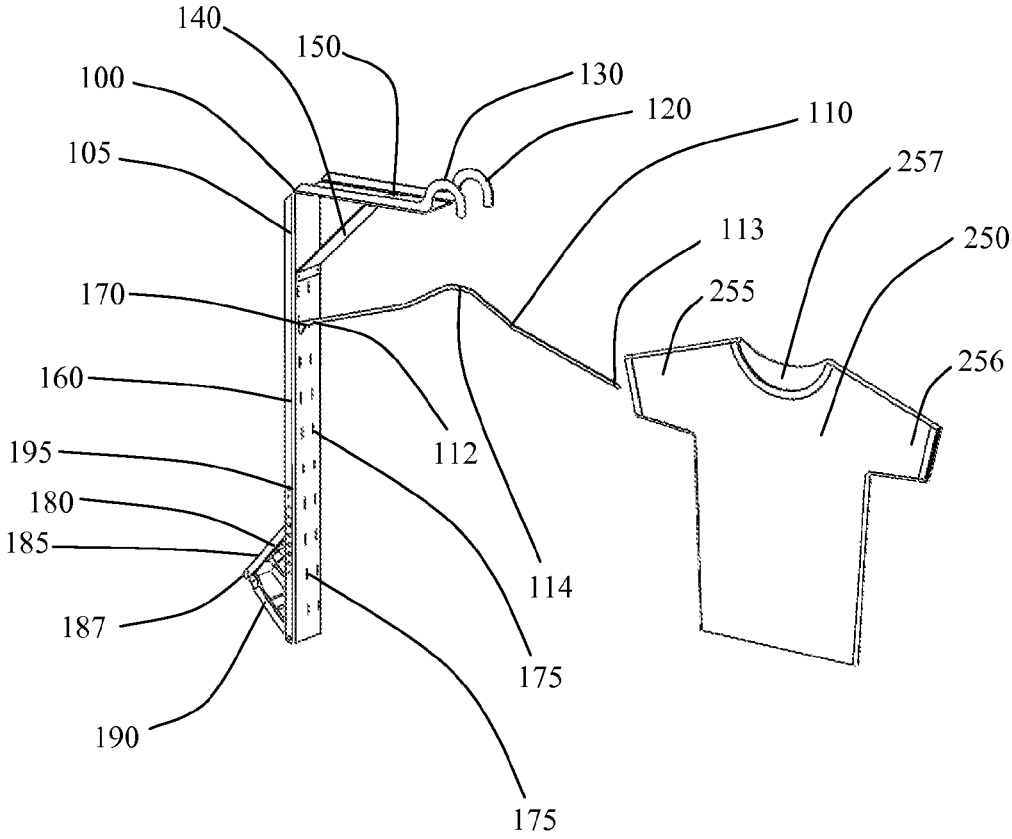
FIG. 7 is a perspective view of an apparatus of FIG. 1 with only one hanger member installed and showing a shirt in front of the apparatus before being mounted on a hanger member.
Figure 8:
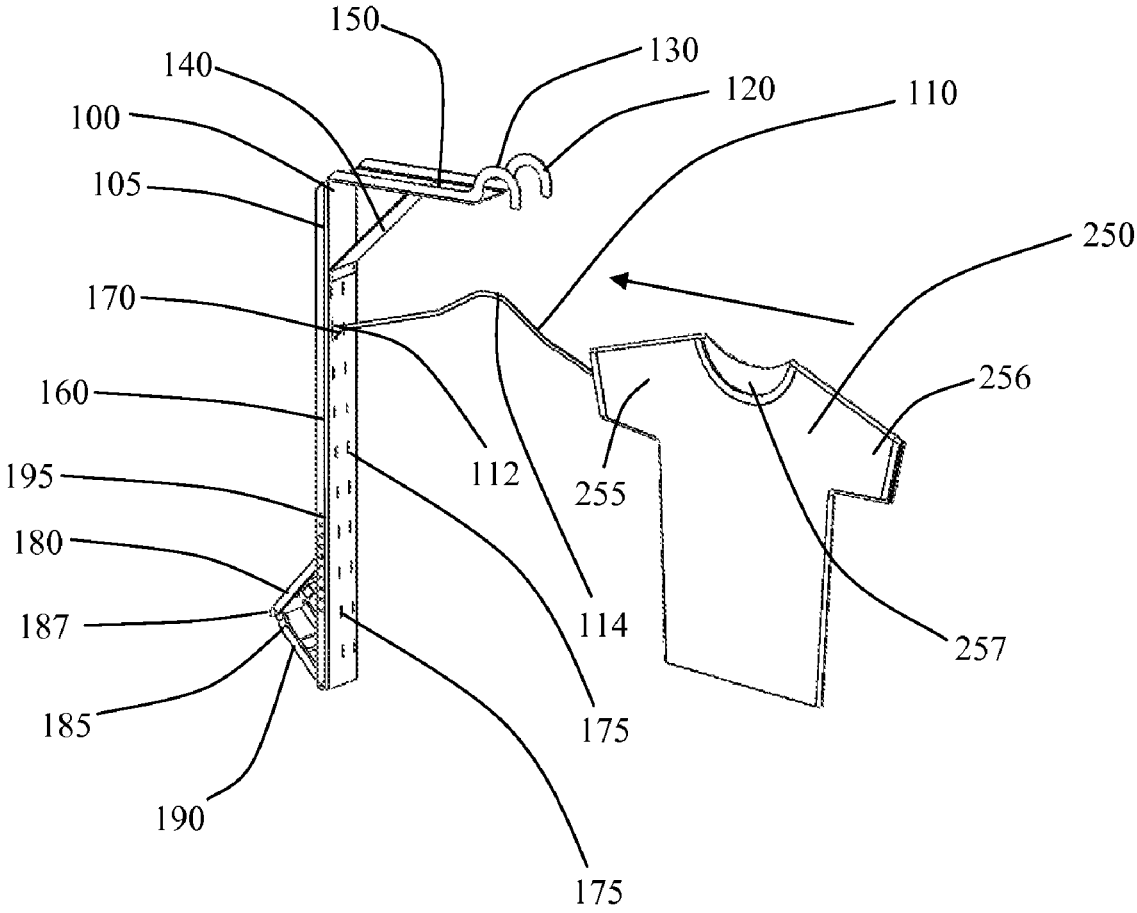
FIG. 8 is a perspective view of an apparatus of FIG. 1 with only one hanger member installed and showing a shirt in the process being mounted onto the hanger member.
Figure 9:
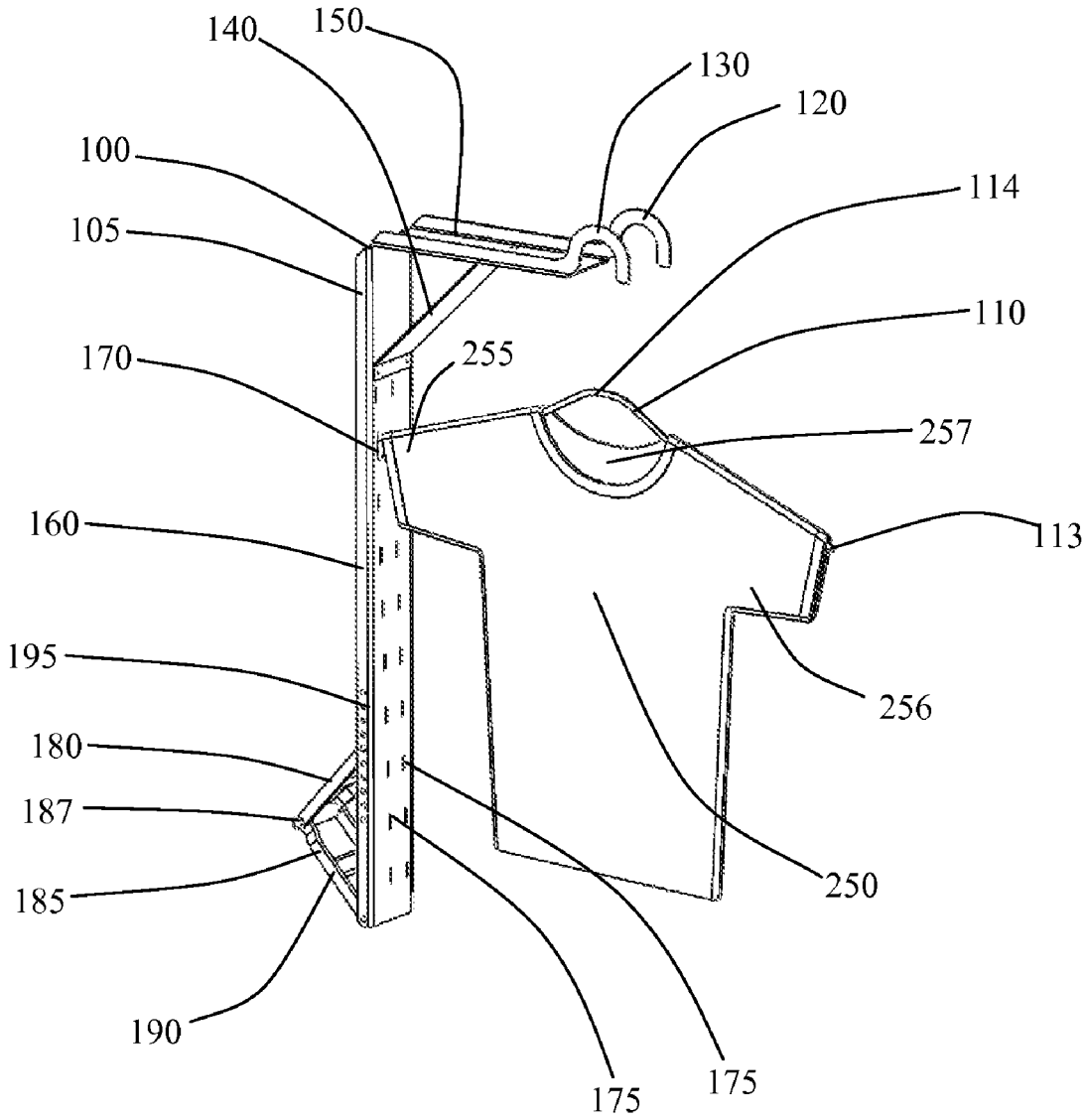
FIG. 9 is a perspective view of an apparatus of FIG. 1 with only one hanger member installed and showing a shirt mounted onto the hanger member.
Figure 10:
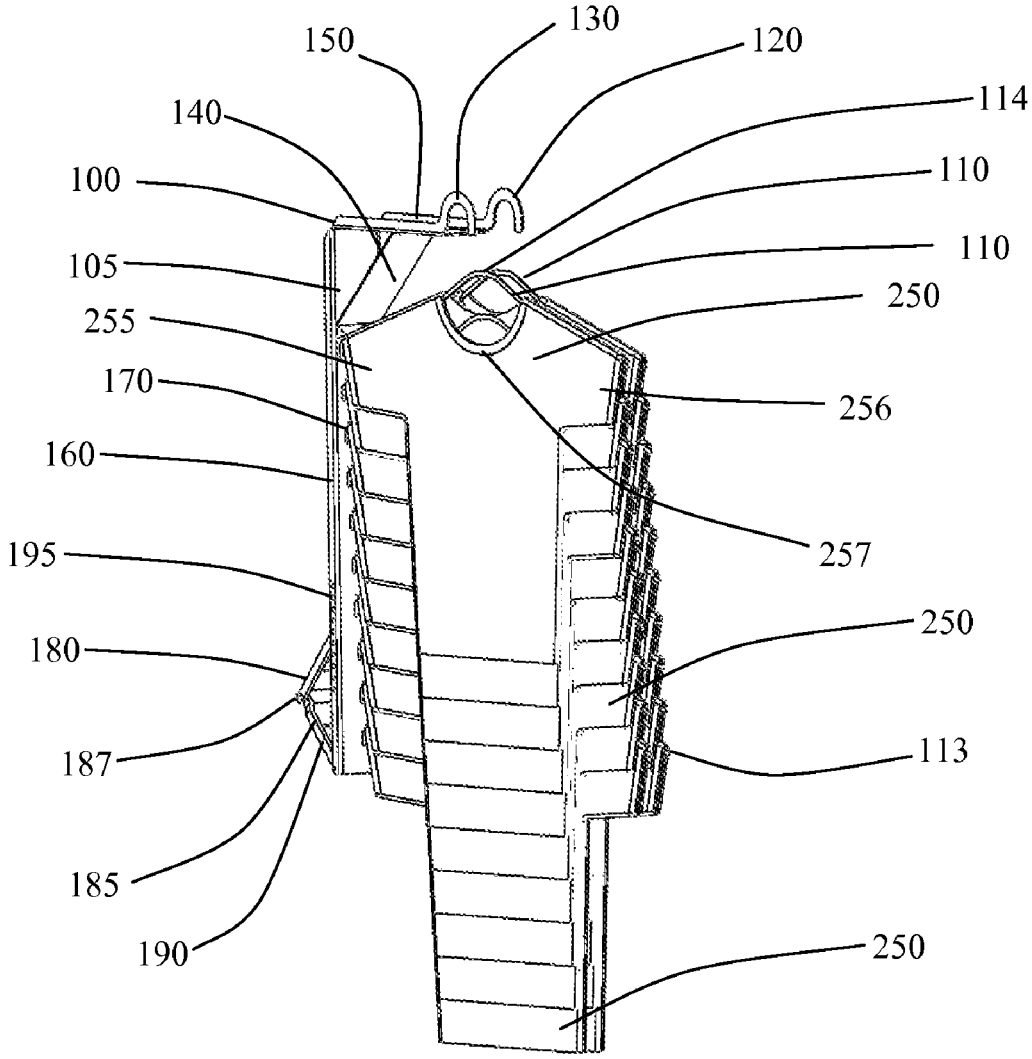
FIG. 10 is a perspective view of an apparatus of FIG. 1 showing a plurality of shirts mounted onto a plurality of hanger members.
Figure 11:
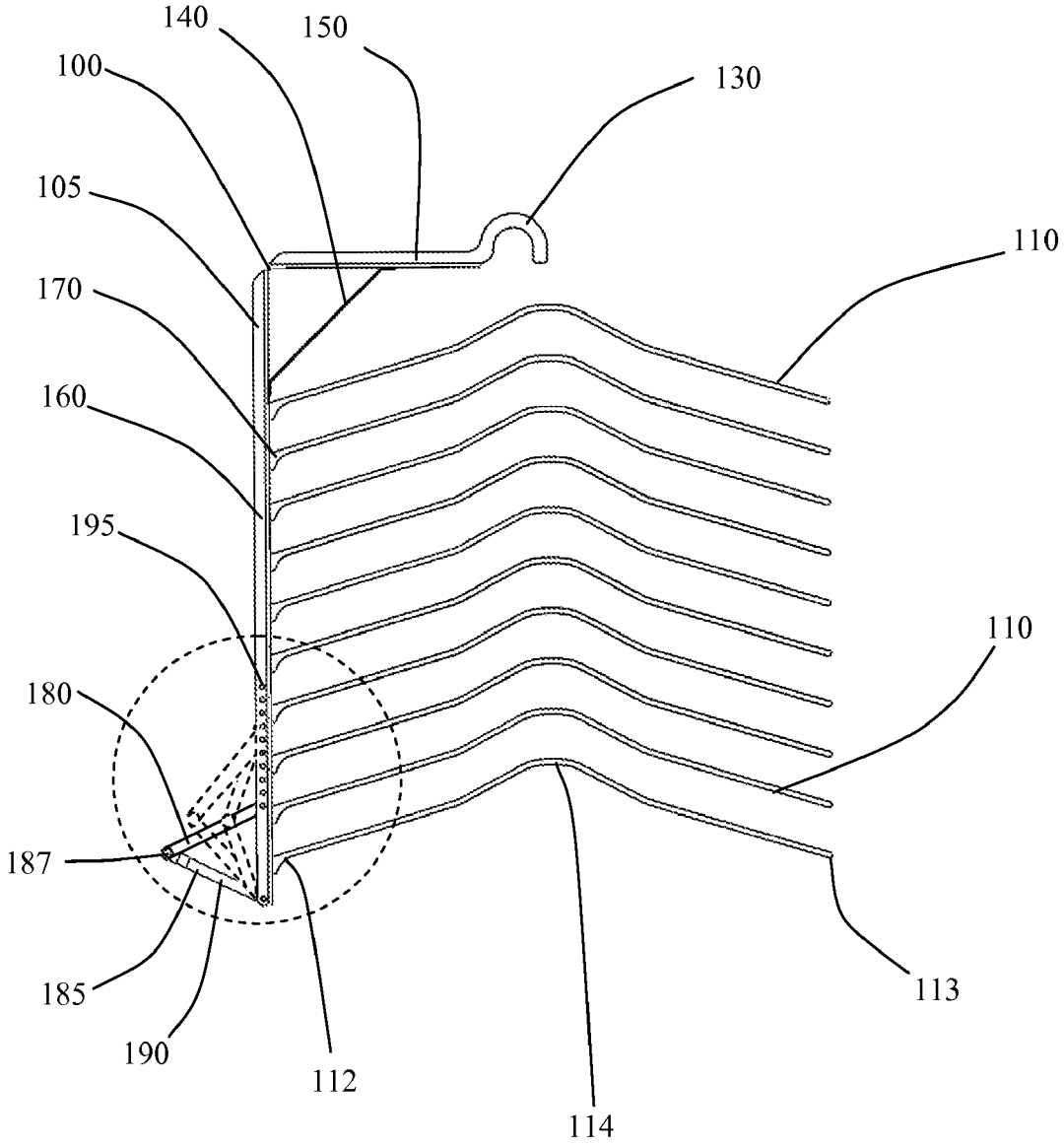
FIG. 11 is a side view of an apparatus of FIG. 1 showing the range of motion of the brace.

Referring now to the most preferred embodiment of the invention in more detail, in FIG. 1, FIG. 2, FIG. 3, FIG. 4, FIG. 5, FIG. 6, FIG. 7, FIG. 8, FIG. 9, FIG. 10, FIG. 11 and FIG. 12, a Clothing Storage Apparatus 100 is illustrated. A Clothing Storage Apparatus 100 comprises a body 105; which comprises an upside-down L-shaped base with an upper horizontal arm 150, which includes a right hook 120 and a left hook 130, and a lower vertical arm 160, which includes a rear-mounted brace 185 that may be adjusted to support the apparatus against the rear wall of a closet, with the upper horizontal arm 150 and the lower vertical arm 160 connected at a substantially perpendicular angle and reinforced by a cross-bar 140; a plurality of hanger arrays 115 depending from the lower vertical arm 160, with each hanger array 115 comprising a plurality of hanger members 110 which have an inner end 112, an outer end 113 and a middle 114, which is peaked, and with each hanger member 110 attached at the inner end 112 to the lower vertical arm 160 by a vertical hinge 170 with the outer end 113 remaining accessible. The rear-mounted brace 185 attaches to the bottom of the lower vertical arm 160 of the body 105. The rear-mounted brace comprises an upper section 180 and a lower section 190 which are connected by a hinge pin 187. The upper section 180 of the rear-mounted brace 185 may be locked into different positions by fitting it into one of the plurality of lock slots 195, thereby fixing its length to the rear wall 200. FIG. 1 shows a perspective view of a Clothing Storage Apparatus 100 standing alone without being mounted in a closet. FIG. 2 illustrates a rear perspective view of a Clothing Storage Apparatus 100 which shows the back side of the apparatus. FIG. 3 depicts a side view of a Clothing Storage Apparatus 100. FIG. 4 illustrates a perspective view of a Clothing Storage Apparatus 100 showing the range of motion of a hanger member 110. FIG. 5 depicts a perspective view of a Clothing Storage Apparatus 100 which is mounted in a standard closet. FIG. 6 illustrated a side view of a Clothing Storage Apparatus 100 mounted within a standard closet. FIG. 7 shows a perspective view of a Clothing Storage Apparatus 100 with only one hanger member 110 installed and with a shirt 250 staged before the Clothing Storage Apparatus 100. FIG. 8 displays a perspective view of a Clothing Storage Apparatus 100 with only one hanger member 110 installed and with a shirt 250 in the process of being mounted onto a hanger member 110. FIG. 9 portrays a perspective view of a Clothing Storage Apparatus 100 with only one hanger member 110 installed and with a shirt 250 mounted on a hanger member 110. FIG. 10 depicts a perspective view of a Clothing Storage Apparatus 100 a plurality of shirts 250 mounted on a plurality of hanger members 110. FIG. 11 illustrates a side view of a Clothing Storage Apparatus 100 which shows the range of motion of the rear brace 185.

In further detail, still referring to the invention of FIG. 1, FIG. 2, FIG. 3, FIG. 4, FIG. 5, FIG. 6, FIG. 7, FIG. 8, FIG. 9, FIG. 10, FIG. 11 and FIG. 12, in FIG. 1, this most preferred embodiment demonstrates the present invention with ten hanger arrays 115, arranged vertically depending from the lower vertical arm 160, with each hanger array comprised of a pair of hanger members 110. This most preferred embodiment is not intended to limit the scope of the present invention, and other embodiments may have a different number of hanger arrays 115 or a different number of hanger members 110 per hanger array 115.

In further detail, still referring to the invention of FIG. 1, FIG. 2, FIG. 3, FIG. 4, FIG. 5, FIG. 6, FIG. 7, FIG. 8, FIG. 9, FIG. 10, FIG. 11 and FIG. 12, in FIG. 2, the most preferred embodiment is displayed from the rear. This most preferred embodiment shows ten hanger arrays 115, with each hanger array 115 comprised of two hanger members 110. FIG. 2 provides a clear view of the hinge slots 175 which are located in the lower vertical arm 160 of the body 105. The member hinges 170 located on the inner end 112 of the hanger members 110 attach to the lower vertical arm 160 of the body 105 at the hinge slots 175.

In further detail, still referring to the invention of FIG. 1, FIG. 2, FIG. 3, FIG. 4, FIG. 5, FIG. 6, FIG. 7, FIG. 8, FIG. 9, FIG. 10, FIG. 11 and FIG. 12, in FIG. 3, the most preferred embodiment is shown in a side view.

In further detail, still referring to the invention of FIG. 1, FIG. 2, FIG. 3, FIG. 4, FIG. 5, FIG. 6, FIG. 7, FIG. 8, FIG. 9, FIG. 10, FIG. 11 and FIG. 12, in FIG. 4, the most preferred embodiment is shown with only one hanger member 110 mounted on the lower vertical arm 160 of the body 105 in order to clearly illustrate the range of motion which one hanger member 110 may provide. The member hinge 170 attached to the lower vertical arm 160 of the body 105 at a hinge slot 175. The member hinge 170 allows the hanger member 110 to swing in a substantially 180-degree arc.

In further detail, still referring to the invention of FIG. 1, FIG. 2, FIG. 3, FIG. 4, FIG. 5, FIG. 6, FIG. 7, FIG. 8, FIG. 9, FIG. 10, FIG. 11 and FIG. 12, in FIG. 5, the most preferred embodiment is shown mounted within a standard closet. The closet is displayed in a sectional perspective view which shows a cross-section 210 of the rear closet wall 200. The right hook 120 and the left hook 130, which extend from the upper horizontal arm 150 of the body 105, are fastened to the closet bar 220 allowing the apparatus 100 to hang from the closet bar 220. The rear-mounted brace 185 is adjusted so that it contacts the closet wall 200 at the contact point 230 enabling the vertical lower arm 160 to sit substantially parallel to the rear closet wall 200.

In further detail, still referring to the invention of FIG. 1, FIG. 2, FIG. 3, FIG. 4, FIG. 5, FIG. 6, FIG. 7, FIG. 8, FIG. 9, FIG. 10, FIG. 11 and FIG. 12, in FIG. 6, the most preferred embodiment is shown in a side view mounted within a closet. The apparatus 100 is displayed suspended from the closet bar 220. The rear-mounted brace 185 is adjusted so that it contacts the rear closet wall 200 at the contact point 230.

In further detail, still referring to the invention of FIG. 1, FIG. 2, FIG. 3, FIG. 4, FIG. 5, FIG. 6, FIG. 7, FIG. 8, FIG. 9, FIG. 10, FIG. 11 and FIG. 12, in FIG. 7, the most preferred embodiment is shown with only one hanger member 110 mounted on the lower vertical arm 160 of the body 105 in order to clearly show the process of mounting an item of clothing on the apparatus. FIG. 7 illustrates the initial step of mounting an item of clothing onto the apparatus 100 and shows a shirt 250 before being mounted onto the hanger member 110 of the apparatus 100. To initiate the mounting of the shirt, the outer end 113 of the hanger member 110 is inserted into the right sleeve 255 of the shirt 250.

In further detail, still referring to the invention of FIG. 1, FIG. 2, FIG. 3, FIG. 4, FIG. 5, FIG. 6, FIG. 7, FIG. 8, FIG. 9, FIG. 10, FIG. 11 and FIG. 12, in FIG. 8, the most preferred embodiment is shown with only one hanger member 110 mounted on the lower vertical arm 160 of the body 105 in order to clearly show the process of mounting an item of clothing on the apparatus. FIG. 8 demonstrates a shirt 250 in the process of being mounted onto a hanger member 110 of the apparatus 100. The hanger member 110 is inserted into the right sleeve 255 of the shirt 250 and the shirt 250 is slid along the hanger member 110 in the direction indicated.

In further detail, still referring to the invention of FIG. 1, FIG. 2, FIG. 3, FIG. 4, FIG. 5, FIG. 6, FIG. 7, FIG. 8, FIG. 9, FIG. 10, FIG. 11 and FIG. 12, in FIG. 9, the most preferred embodiment is shown with only one hanger member 110 mounted on the lower vertical arm 160 of the body 105 in order to clearly show an item of clothing mounted on a hanger member 110 of the apparatus 100. FIG. 9 illustrates a shirt 250 mounted on a single hanger member 110. Once the shirt 250 is mounted, the middle 114 of the hanger member 110 distends through the neck 257 of the shirt 250, and the outer end 113 of the hanger member 110 extends through the left sleeve 256 of the shirt 250.

In further detail, still referring to the invention of FIG. 1, FIG. 2, FIG. 3, FIG. 4, FIG. 5, FIG. 6, FIG. 7, FIG. 8, FIG. 9, FIG. 10, FIG. 11 and FIG. 12, in FIG. 10, the most preferred embodiment is shown fully loaded with items of clothing. FIG. 10 demonstrates the most preferred embodiment storing twenty shirts 250 in a relatively narrow space. Each shirt 250 is mounted on a single hanger member 110. Once the desired number of shirts is mounted onto their respective hanger members 110, the hanger members 110 may be adjusted to a substantially perpendicular angle to the lower vertical arm 160 so that all of the shirts are stored in a substantially flat volume. In essence, this most preferred embodiment allows for twenty shirts to be stored in a closet in a volume normally suited for storing only one shirt.

Figure 12:
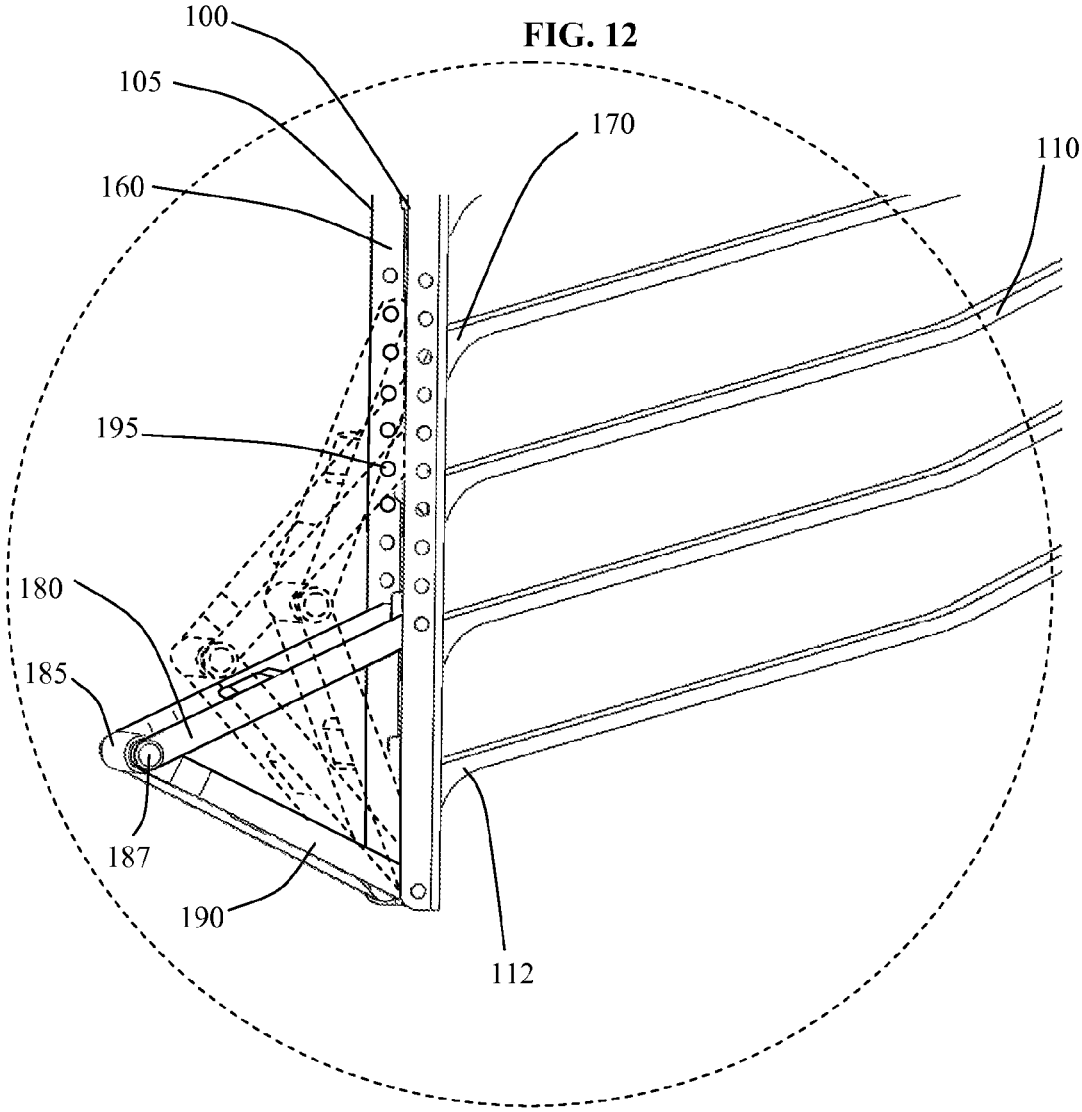
FIG. 12 is a perspective view of an apparatus of FIG. 1 showing a close-up of the brace of FIG. 11 and depicting the range of motion of the brace.

In further detail, still referring to the invention of FIG. 1, FIG. 2, FIG. 3, FIG. 4, FIG. 5, FIG. 6, FIG. 7, FIG. 8, FIG. 9, FIG. 10, FIG. 11 and FIG. 12, in FIG. 11 and FIG. 12, the most preferred embodiment is shown with a detail of the rear-mounted brace 185. FIG. 11 indicates the region of the apparatus 100 which is provided in more detail in FIG. 12. FIG. 12 shows a close-up of the rear-mounted brace 185. FIG. 11 and FIG. 12 illustrate the range of motion of the rear-mounted brace 185. The rear-mounted brace 185 attaches to the bottom of the lower vertical arm 160 of the body 105. The rear-mounted brace comprises an upper section 180 and a lower section 190 which are connected by a hinge pin 187. The upper section 180 of the rear-mounted brace 185 may be locked into different positions by fitting it into one of the plurality of lock slots 195. Using lock slots 195 which are closer to the center of the lower vertical arm 160 corresponds to relatively smaller extensions of the rear-mounted brace from the lower vertical arm 160, while using lock slots 195 which are closer to the bottom of the lower vertical arm 160 correspond to relatively larger extensions of the rear-mounted brace 185 from the lower vertical arm 160.

The construction details of the invention as shown in FIG. 1, FIG. 2, FIG. 3, FIG. 4, FIG. 5, FIG. 6, FIG. 7, FIG. 8, FIG. 9, FIG. 10, FIG. 11 and FIG. 12, are that a Clothing Storage Apparatus 100 comprises a body 105 and a plurality of hanger arrays 115 depending from the body 105, with each hanger array 115 comprising a plurality of hanger members 110. The body comprises an upside-down L-shaped base with an upper horizontal arm 150, which includes a right hook 120 and a left hook 130, and a lower vertical arm 160, which includes a rear-mounted brace 185 that may be adjusted to support the apparatus against the rear wall of a closet. The upper horizontal arm 150 and the lower vertical arm 160 of the body 105 are connected at a substantially perpendicular angle and reinforced by a cross-bar 140. The upper horizontal arm 150 is comprised of metal, sheet metal, steel, sheet steel, galvanized steel, stainless steel, aluminum, sheet aluminum, brass, copper, sheet copper, wood, plastic, composite material or the like. The lower vertical arm 160 is comprised of metal, sheet metal, steel, sheet steel, galvanized steel, stainless steel, aluminum, sheet aluminum, brass, copper, sheet copper, wood, plastic, composite material or the like. The right hook 120 and the left hook 130 are comprised of metal, sheet metal, steel, sheet steel, galvanized steel, stainless steel, aluminum, sheet aluminum, brass, copper, sheet copper, wood, plastic, composite material or the like. The cross bar 140 is comprised of metal, sheet metal, steel, sheet steel, galvanized steel, stainless steel, aluminum, sheet aluminum, brass, copper, sheet copper, wood, plastic, composite material or the like. The hanger members have an inner end 112, an outer end 113 and a middle 114, which is peaked, and each hanger member 110 is attached at the inner end 112 to the lower vertical arm 160 by a vertical hinge 170 with the outer end 113 remaining accessible. The hanger members 110 are comprised of metal, sheet metal, steel, sheet steel, galvanized steel, stainless steel, aluminum, sheet aluminum, brass, copper, sheet copper, wood, plastic, composite material or the like. The vertical hinge is comprised of metal, sheet metal, steel, sheet steel, galvanized steel, stainless steel, aluminum, sheet aluminum, brass, copper, sheet copper, wood, plastic, composite material or the like. The rear-mounted brace 185 attaches to the bottom of the lower vertical arm 160 of the body 105. The rear-mounted brace comprises an upper section 180 and a lower section 190 which are connected by a hinge pin 187. The upper section 180 of the rear-mounted brace 185 may be locked into different positions by fitting it into one of the plurality of lock slots 195, thereby fixing its length to the rear wall 200. The rear-mounted brace is comprised of metal, sheet metal, steel, sheet steel, galvanized steel, stainless steel, aluminum, sheet aluminum, brass, copper, sheet copper, wood, plastic, composite material or the like.

The advantages of the present invention include, without limitation, that it allows for multiple items of clothing to be organized and stored in a space normally reserved for one item of clothing and allows for that clothing to be clearly displayed. The Clothing Storage Apparatus 100 saves closet space by increasing the number of garments that can be stored along a given length of a closet bar. The rear-mounted brace provides stability for the apparatus 100 while it is being loaded with items of clothing. Furthermore, the vertical-hinged hanger members 110 allow for the hanging clothing to be clearly displayed and easily searched through because they can be easily viewed by swinging a vertical-hinged hanger member 110 open. Additionally, the apparatus allows for a set of clothing to be easily removed from a closet for travel.

In broad embodiment, the present invention is a Clothing Storage Apparatus comprising a body which may be suspended from a closet bar and a plurality of hanger arrays, each hanger array comprising a plurality of hanger members which may support an item of clothing. The hanger members are mounted on vertical hinges such that the hanger members may be easily loaded with an item of clothing without interfering with other hanger members. Once the hanger members are loaded with items of clothing, the hanger members may be returned to a position in which the items of clothing hang substantially parallel to a single item of clothing mounted on a standard hanger. A Clothing Storage Apparatus allows for multiple items of clothing to be stored in a volume normally used by one item of clothing and is a convenient and efficient means for storing multiple items of clothing in limited closet space.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiments, methods, and examples, but by all embodiments and methods that are within the scope and spirit of the invention as claimed.

What is claimed is:

1. An apparatus for organizing and storing clothing comprises a body, said body comprising an upside-down L-shaped structure comprising an upper horizontal arm and a lower vertical arm, said upper horizontal arm and said lower vertical arm being connected at a substantially perpendicular angle and reinforced by a cross-bar, said body provided with a means to hang from a closet bar, said means to hang from a closet bar comprising two parallel horizontal hooks depending from the forward end of said upper horizontal arm, a V-shaped rear-mounted brace depending from the bottom end of said lower vertical arm of said body, whereby said V-shaped rear-mounted brace is provided with a means of adjusting it length from said body in order to support said apparatus against a rear wall of a closet, said length adjusting means comprising folding and locking, and one or more hanger arrays depending from said body, said hanger array comprising one or more hanger members, said hanger members attached to said lower vertical arm by a vertical hinge, said hanger members comprising two ends, an inner end and an outer end, and a middle, wherein said inner end is attached to said body by said vertical hinge with said outer end freely suspended, and wherein said middle is peaked such that the center is vertically higher than either said inner end or said outer end, whereby said hanger members are capable of supporting an item of clothing.

* * * * *